United States Patent [19]

Ohta et al.

[11] Patent Number: 4,674,957

[45] Date of Patent: Jun. 23, 1987

[54] CONTROL MECHANISM FOR VARIABLE DISPLACEMENT SWASH PLATE TYPE COMPRESSOR

[75] Inventors: Masaki Ohta, Anjo; Shinichi Suzuki, Okazaki; Kenji Takenaka, Kariya, all of Japan

[73] Assignee: Kabushiki Kaisha Toyoda Jidoshokki Seisakusho, Aichi, Japan

[21] Appl. No.: 810,392

[22] Filed: Dec. 18, 1985

[30] Foreign Application Priority Data

Dec. 22, 1984 [JP] Japan ..... 59-271622
Dec. 22, 1984 [JP] Japan ..... 59-271623
Dec. 22, 1984 [JP] Japan ..... 59-271624

[51] Int. Cl.[4] ..... F04B 1/26; F16H 23/00

[52] U.S. Cl. ..... 417/222; 417/270; 92/12.2; 74/60

[58] Field of Search ..... 417/222, 269, 270; 92/12.2; 91/505; 74/60

[56] References Cited

U.S. PATENT DOCUMENTS 2,964,234 12/1960 Loomis ..... 74/60 X
3,062,020 11/1962 Heidorn ..... 417/270 X
4,037,993 7/1977 Roberts ..... 417/222
4,061,443 12/1977 Black et al. ..... 417/222
4,175,915 11/1979 Black et al. ..... 417/222
4,428,718 1/1984 Skinner ..... 417/222
4,543,043 9/1985 Roberts ..... 417/222
4,586,874 5/1986 Hiraga et al. ..... 417/270

*Primary Examiner*—Carlton R. Croyle
*Assistant Examiner*—Paul F. Neils
*Attorney, Agent, or Firm*—Burgess, Ryan & Wayne

[57] ABSTRACT

A variable displacement swash plate type compressor having a cylinder block in which a drive shaft is centrally and axially extended so as to mount thereon a swash plate assembly to drive pistons reciprocally arranged in a plurality of cylinder bores arranged circumferentially about the drive shaft. The swash plate assembly has a rotary swash plate and a non-rotary wobble plate in a crankcase formed in the cylinder block and a mechanism for changing the wobble angle of the swash plate and the wobble plate by turning them about an axis extending at a right angle to the rotating axis of the drive shaft and passing through points which come into registration with respective centers of connection of connecting rods of the pistons and the wobble plate when the pistons are at the top dead center of their strokes within the cylinder bores.

5 Claims, 17 Drawing Figures

CONTROL MECHANISM FOR VARIABLE DISPLACEMENT SWASH PLATE TYPE COMPRESSOR

BACKGROUND OF THE INVENTION

1. Field of the Invention

The present invention relates to a variable displacement, swash plate type compressor for use in an air-conditioner for air-conditioning vehicle compartment. More particularly, it relates to a control mechanism for changing the displacement of a compressor by changing an angle of wobble of a swash plate assembly so that pistons in the compressor can be driven in association with a change in a cooling load within an air-conditioned area, i.e. the vehicle compartment.

2. Description of the Related Art

Generally, a swash plate type compressor is provided with a plurality of cylindrical bores (cylinders) arranged circumferentially around the center of rotation of a swash plate, with a plurality of pistons slidably fitted in associated cylinders, respectively, and reciprocated by the wobbling motion of the rotating swash plate so that the reciprocating pistons successively pump a refrigerant gas into and compress the same within the cylinder bores. To vary the displacement of such swash plate type compressor in association with a change in a cooling load, a control system is conventionally employed for changing the wobble angle of the rotary swash plate in compliance with a change in a suction pressure which accompanies a change in a cooling load within a closed space to be air-conditioned, such as a vehicle compartment.

Two typical control systems for changing the wobble angle of a rotary swash plate of a variable displacement swash plate type compressor are disclosed in U.S. Pat. No. 4,428,718 to Skinner and U.S. Pat. No. 4,037,993 to Roberts.

In the control system of the former U.S. Patent, the wobble angle of the swash plate that is directly related to the compressor displacement is controlled by a crankcase-suction pressure differential. The control system has a displacement control valve, responsive to both compressor suction and discharge pressure, arranged to provide controlled communication of same with the compressor crankcase so that the compressor displacement, and thus the discharge flow rate, is increased with an increase in discharge pressure and with an increase suction pressure.

In the variable displacement, swash plate type compressor of the latter U.S. Patent, the control system includes a fluid actuator for shifting a centering ball on which the cam mechanism is supported, to effect a change in the piston stroke length by varying the angle of inclination of the wobbling swash plate with respect to the drive shaft axis of the compressor.

However, in the former control system, a non-rotary wobble plate joined to a rotary swash plate via needle bearings is operatively connected to a lug member radially projecting from a drive shaft by the engagement of a cross pin in a guide slot formed in the lug member. Thus, the accuracy of control of the angle of inclination of the wobble and swash plates is insufficient. Also, the engagement of the cross pin and the lug member lacks mechanical durability against a compression reaction force caused by the pistons. Further, wear is apt to occur at the engaging portion of the cross pin and the guide slot of the lug member, resulting in the occurrence of unfavorable play in the mechanism for changing the wobble angle of the wobble and swash plates. As a result, stability of the repeated reciprocatory motion of the pistons cannot be ensured over a long period.

In the latter control system, link and pin members are employed for connecting a swash plate assembly to a drive shaft assembly of the compressor. Accordingly, it is difficult to achieve a high accuracy of control of the wobble angle of the swash plate assembly. Also, such a connecting mechanism consisting of link and pin members is insufficient for long-term mechanical durability against a compression reaction force caused by the reciprocatory pistons. In addition, the control system of the latter U.S. Patent has a complicated mechanical construction, reducing reliability in the operation thereof.

SUMMARY OF THE INVENTION

An object of the present invention is to provide an improved control mechanism for changing the wobble angle of a swash plate assembly of a variable displacement swash plate type compressor.

Another object of the present invention is to provide a variable displacement, swash plate type compressor provided therein with a control mechanism for changing the wobble angle of the swash plate assembly and thereby changing the compressor displacement in association with a change in a cooling load, which mechanism has an improved operation reliability and constructional durability.

In accordance with the present invention, there is provided a variable displacement swash plate type compressor which includes a cylinder block having therein a plurality of cylinder bores arranged circumferentially around a central axis thereof, along which a drive shaft is arranged so as to axially extend, and also having therein a crankcase communicated with the plurality of cylinder bores, a first housing attached to one end of the cylinder block so as to form suction and discharge chambers which are alternately communicated with each of the plurality of cylinder bores, a second housing attached to the other end of the cylinder block so as to close the crankcase of the cylinder block, a plurality of pistons slidably fitted in the cylinder bores and reciprocating so as to compress a refrigerant gas drawn from the suction chamber and to then discharge the compressed gas into the discharge chamber, and a swash plate assembly arranged in the crankcase and mounted on the drive shaft so as to reciprocate the pistons, the swash plate assembly including a swash plate capable of rotating with the drive shaft while wobbling about an axis perpendicular to a rotating axis of the drive shaft, and a non-rotatable wobble plate held on the swash plate, operatively connected to the pistons by connecting rods and capable of wobbling with the swash plate, the swash plate and wobble plate being arranged in such a manner that the wobble angle thereof can be changed in response to a change in a pressure condition of the crankcase established by a conduit means communicating the crankcase with one of the suction and discharge chambers. The compressor is characterized in that the swash plate assembly comprises means for supporting the swash plate in such a manner that it can freely turn about an axis extending at a right angle to the rotating axis of the drive shaft and pass through points which come into registration with respective centers of connection of the connecting rods and the wobble plate when the pistons are at the top dead centers of their strokes within the cylinder bores.

BRIEF DESCRIPTION OF THE DRAWINGS

The present invention will be made more apparent from the ensuing description of an embodiment with reference to the accompanying drawings, wherein.

DESCRIPTION OF THE PREFERRED EMBODIMENTS

Figure 1:
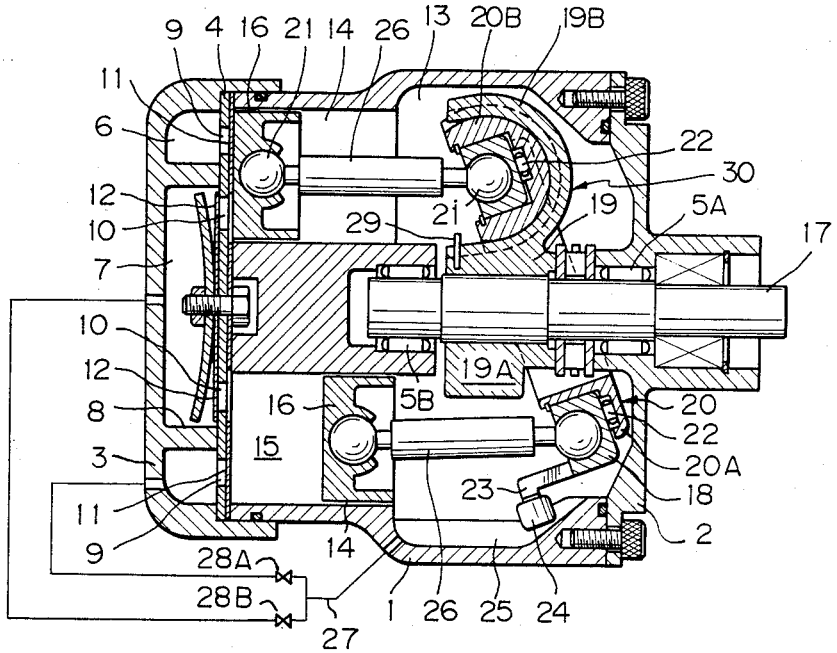
FIG. 1 is a cross-sectional view of a variable displacement swash plate type compressor, according to a first embodiment of the present invention.
Figure 2:
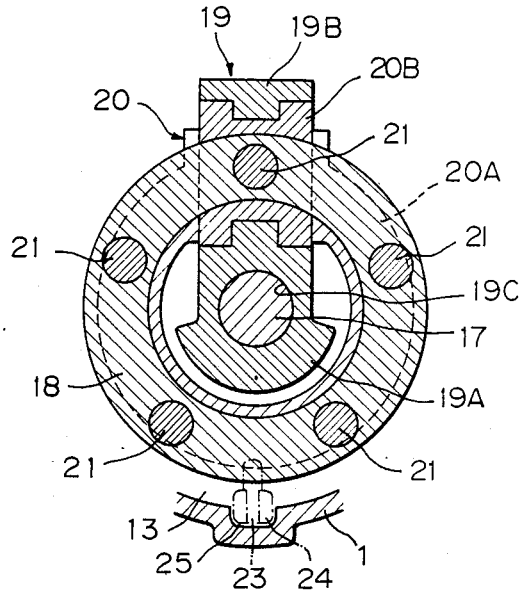
FIG. 2 is a cross-sectional view of a swash plate assembly accommodated in the compressor of FIG. 1.
Figure 3:
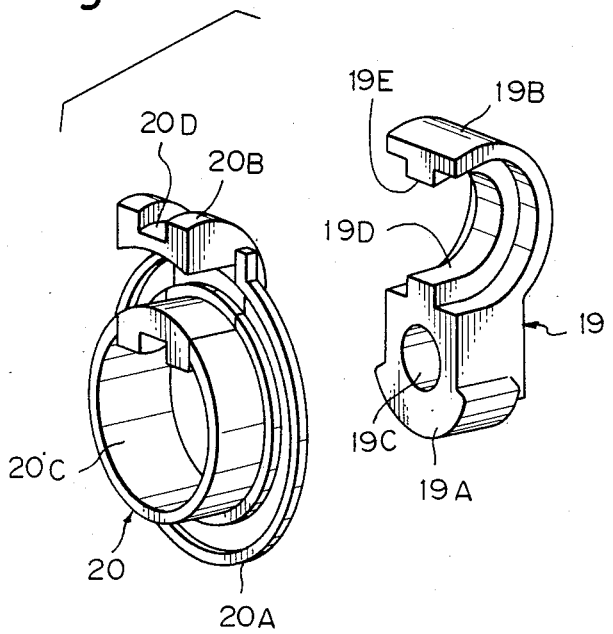
FIG. 3 is an exploded perspective view of a support member and a swash plate employed in the compressor of FIG. 1.

Referring to FIGS. 1 through 3, which illustrate the first embodiment of the present invention, the variable displacement swash plate type compressor includes a cylindrical cylinder block 1 having one axial end, i.e., a front end closed by a front housing 2 and another axial end, i.e., a rear end closed by a rear housing 3 via a valve plate 4. The front housing 2 has a bearing 5A fitted in the central portion thereof for rotatably supporting one end of a drive shaft 17, the other end of which is also rotatably supported by another bearing 5B fitted in a rear side of the cylinder block 1 so as to be coaxial with the bearing 5A.

The rear housing 3 has a suction chamber 6 and a discharge chamber 7 coaxial with one another and separated by an annular partition wall 8. The discharge chamber 7 is centrally arranged, and the suction chamber 6 is arranged so as to externally enclose the discharge chamber 7. The suction and discharge chambers 6 and 7 are communicated with compression chambers 15 of later-described cylinder bores 14, respectively, via suction ports 9 and discharge ports 10 which are formed in the valve plate 4. Suction valves 11 are provided for opening and closing the associated suction ports 9 in response to the reciprocating motion of pistons 16 within the cylinder bores 14. That is, when each piston 16 is at its suction stroke, the associated suction valve 11 is operated so as to open the related suction port 9. Discharge valves 12 are provided for opening and closing the associated discharge ports 10 in compliance with the reciprocating motion of the pistons 16. That is, when each piston 16 is at its compression stroke, the associated discharge valve 12 is operated so as to open the related discharge port 10. The axial cylinder bores 14 bored in the cylinder block 1 are disposed around the center of the bearing 5B and the reciprocatory pistons 16 are fitted therein, respectively. Each of the cylinder bores 14 has, on the rear side thereof, its compression chamber 15 which is alternately communicatable with the suction chamber 6 and the discharge chamber 7, via the associated suction port 9 and discharge port 10, respectively. A crankcase 13 is formed in the front side of the cylinder block 1 so as to be communicated with all of the cylinder bores 14. Through the crankcase 13, the afore-mentioned drive shaft 17 supported by the afore-mentioned bearings 5A and 5B axially extends and a swash plate assembly 30 is mounted thereon which is capable of changing the wobbling angle. The swash plate assembly 30 includes a support member 19 fixed to the drive shaft 17 and extending radially in the crankcase 13 from the drive shaft 17, a non-rotary wobble plate 18, and a rotary swash plate supported on the support member 19 so as to be capable of wobbling about an axis which is parallel with another axis perpendicular to the axis of the drive shaft 17. The support member 19 has a mount 19A by which the support member 19 is fixedly mounted on the drive shaft 17, and a stand 19B on which the rotary swash plate 20 is supported. The mount 19A is provided with an axial through-hole 19C into which the drive shaft 17 is inserted. The stand 19B in the form of a semicircular arc member integral with the mount 19A is provided with a tooth 19D in the form of a roundly curved convex portion formed in the semicircular inner face of the semicircular arc member, and a mouth 19E opening toward the rear side of the cylinder block 1, i.e., the cylinder bore 14.

The rotary swash plate 20 has an annular mounting flange portion 20A formed at an end of a cylindrical body portion 20C for supporting the wobble plate 18, and a wobbling head 20B having a semicircular outer face complementary with the semicircular inner face of the stand 19B. The semicircular outer face of the wobbling head 20B is formed with a semicircularly curved groove 20D slidably engageable with the tooth 19D of the support member 19. That is, the swash plate 20 is able to wobble against the support member 19 through the engagement of the wobbling head 20B and the stand 19B. The annular mounting flange 20A as well as the cylindrical body portion 20C of the swash plate 20 are disposed so as to enclose the drive shaft 17 and the mount 19A of the support member 19. Since the support member 19 is fixed to the drive shaft 17 by the tight engagement of the mount 19 and the drive shaft 17, the support member 19 is able to be rotated with the drive shaft 17 and rotates the swash plate 20 about the drive shaft 17. The swash plate 20 is mounted on the non-rotary wobble plate 18 with a bearing 22 intervened between an end face of the non-rotary wobble plate 18 and the mounting flange 20A of the swash plate 20. The wobble plate 18 is formed as an annular member and is disposed so as to enclose the drive shaft 17, and is provided, at a part of the outer portion thereof, with a projection 23 having an outer end located externally from the outer periphery of the wobble plate 18. To an outer end of the projection 23 is attached a rollable stop 24 which is engaged in an axially extended guide slot 25 formed in the inner face of the crankcase 13 of the cylinder block 1. The rollable stop 24 prevents the rotation of the wobble plate 18 around the drive shaft 17. However, the rollable stop 24 permits the wobble plate 18 to wobble together with the swash plate 20 by rolling in the guide slot 25 of the cylinder block 1.

The wobble plate 18 of the swash plate assembly 30 is operatively connected to each of the pistons 16 by means of a connecting rod 26 and two ball bearings 21 attached to both ends of the connecting rod 26. That is, the provision of the bearing balls 21 on the opposite ends of each connecting rod 26 permits the formation of a universal joint between the connecting rod 26 and the piston 16 and the wobble plate 18. At this stage, it should be understood that when the drive shaft 17 is rotated, the support member 19 on the drive shaft 17 is also rotated and successively brought into axial alignment with one of the cylinder bores 14. When the support member 19 is in axial alignment with any one of the cylinder bores 14, the associated piston 16 is displaced to the top dead center of its stroke within the cylinder bore 14 due to the wobbling motion of the swash plate assembly 30.

A conduit 27 schematically illustrated in FIG. 1 is provided for permitting either a suction gas or a discharge gas within the compressor to flow into the crankcase 13, via valves 28A and 28B which can be alternately and automatically opened.

A stop 29 illustrated in FIG. 1 is disposed at an end of the stand 19 so as to project into the mouth 19E. The stop 29 is provided for preventing an excessive wobbling motion of the wobbling head 20 about a predetermined angularly erected position of the swash plate assembly 30, i.e., the least inclined position of the swash plate assembly. The predetermined angularly erected position is usually set to a position between 3 and 6 degrees inclined from the true vertical, and the inclination of the wobble angle of the swash plate assembly is varied by controlling a pressure condition within the crankcase 13.

The operation of the variable displacement, swash plate type compressor of the first embodiment illustrated in FIGS. 1 through 3 will now be described.

When the compressor is at a standstill due to disconnection of the drive shaft 17 from a drive source, i.e., a vehicle engine, the compression chambers 15 of the cylinder bores 14 and the crankcase 13 are in an equal pressure condition. Therefore, the wobble plate 18 of the swash plate assembly 30 is maintained at a position closest to the predetermined erected position. Accordingly, every piston 16 is stopped at a position not far from the top dead center of its stroke.

When the drive shaft 17 is connected to the drive source by the operation of a coupling means, such as a conventional electromagnetic clutch, the drive shaft 17 begins to rotate while simultaneously causing the rotation of the swash plate 20 and the support member 19. However, at that time, since the swash plate assembly 30 is at substantially the least inclination position, the wobbling motion of the swash plate 20 and the wobble plate 18 is kept to a minimum. As a result, the pistons 16 within the cylinder bores 14 cannot exert a sufficient reciprocating stroke. That is, at the start of the compression, an appreciable compressing motion of the pistons does not occur.

In accordance with the progress of operation of the compressor, one of the suction and discharge pressures is selectively supplied into the crankcase 13 during the operation of the compressor, due to opening of one of the valves 28A and 28B, so that a differential pressure is established between the compression chambers 15 of the cylinder bores 14 and the crankcase 13. This differential pressure causes each piston 16 to shift toward or away from the crankcase 13 within each associated cylinder bore 14 until the pressures in both compression chambers 15 and crankcase 13 are balanced. The above-mentioned shift of the pistons 16 toward or away from the crankcase 13 applies a pressure or drawing force to the wobble plate 18 via the connecting rods 26. Accordingly, the inclination of the wobble plate 18 together with the swash plate 20 is varied with respect to the axis of the drive shaft 17. That is, the wobble plate 18 and the swash plate 20 of the swash plate assembly 30 turn about an axis which is parallel with another axis perpendicular to the axis of the drive shaft 17, due to the rotation of the wobbling head 20B within the stand 19B of the support member 19. The turning of the above-mentioned swash plate assembly 30 continues until the above-mentioned pressure balance condition is achieved. Note that the rotation of the wobbling head 20B occurs about an axis which exactly corresponds to the above-mentioned turning axis of the swash plate assembly 30 and passes through a point at which the center of the connection of each connecting rod 26 and the wobble plate 18 is located when the stand 19B of the support member 19 comes in alignment with each associated cylinder bore 14. When the swash plate 20 of the inclined swash plate assembly 30 is rotated by the drive shaft 17, the non-rotary wobble plate 18 wobbles, causing a reciprocating motion of all pistons 16 within the associated cylinder bores 14. As a result, suction and compression of a refrigerant gas are carried out by the pistons 16.

During the operation of the compressor, when a cooling load in an air-conditioned area, such as a vehicle compartment, is large, the valve 28A communicated with the suction chamber 6 is opened so that the suction gas is introduced into the crankcase 13, whereby a suction pressure prevails in the crankcase 13. Therefore, a large pressure difference is established between the compression chambers 15 and the crankcase 13. Thus, pressure is applied to the wobble plate 18 from the pistons 16 via the connecting rods 26, causing an increase of the angle of inclination (wobble angle) of the swash plate assembly 30. As a result, the pistons 26 reciprocate at an increased stroke, thus increasing the displacement of the compressor.

On the other hand, when the cooling load in the air-conditioned area becomes low, the valve 28A is closed and the other valve 28B is alternately opened so that the discharge gas is introduced into the crankcase 13 and accordingly, a discharge pressure prevails in the crankcase 13. As a result, the pressure difference between the compression chambers 15 and the crankcase 13 is diminished. Consequently, the angle of inclination of the swash plate assembly 30 is decreased. Accordingly, the pistons 26 reciprocate at a reduced stroke thereby decreasing the displacement of the compressor.

From the foregoing description of the first embodiment of the present invention, it will be understood that the wobble angle changing mechanism of the swash plate assembly is extremely simplified due to the provision of a support member having a semicircular wobbling stand and a wobbling head of the swash plate complementarily engaged in the stand. It should be particularly appreciated that, since the engagement of the wobbling head of the swash plate and the stand of the support member is accomplished by surface contact therebetween, the mechanical durability of the swash plate assembly against a reaction force from the reciprocating pistons and the stability of the wobbling motion of the swash plate assembly can be very high. Thus, it is ensured that reliable operation of a variable displacement, swash plate type compressor is obtained.

Figure 4:
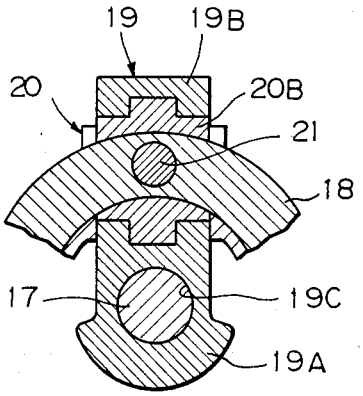
FIGS. 4 and 5 are partial views similar to FIG. 2, illustrating two different modifications of the wobble angle changing mechanism of the swash plate assembly of FIG. 2.
Figure 5:
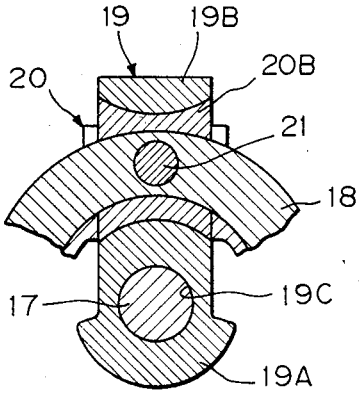

FIGS. 4 and 5 illustrate two modifications of the wobbling angle changing mechanism of the swash plate assembly 30 of FIGS. 1 through 3.

In the modification of FIG. 4, the stand 19B of the support member 19 is formed with a semicircular curved groove in the inner face of the member 19, and the wobbling head 20B is formed, in the outer face thereof, with a semicircular curved tooth movably engaged in the groove of the stand 19B.

In the other modification of FIG. 5, the stand 19B of the support member 19 is formed, in the inner face thereof, with a semicircular extended convex surface, and the wobbling head 20B is formed, in the outer face thereof, with a semicircular extended concave surface is complementary and movably engaged with the convex surface of the stand. The above-mentioned two modifications are obviously able to ensure the mechanical durability of the swash plate assembly and the stability of the wobbling of the swash plate assembly in the same way as in the first embodiment.

Figure 6:
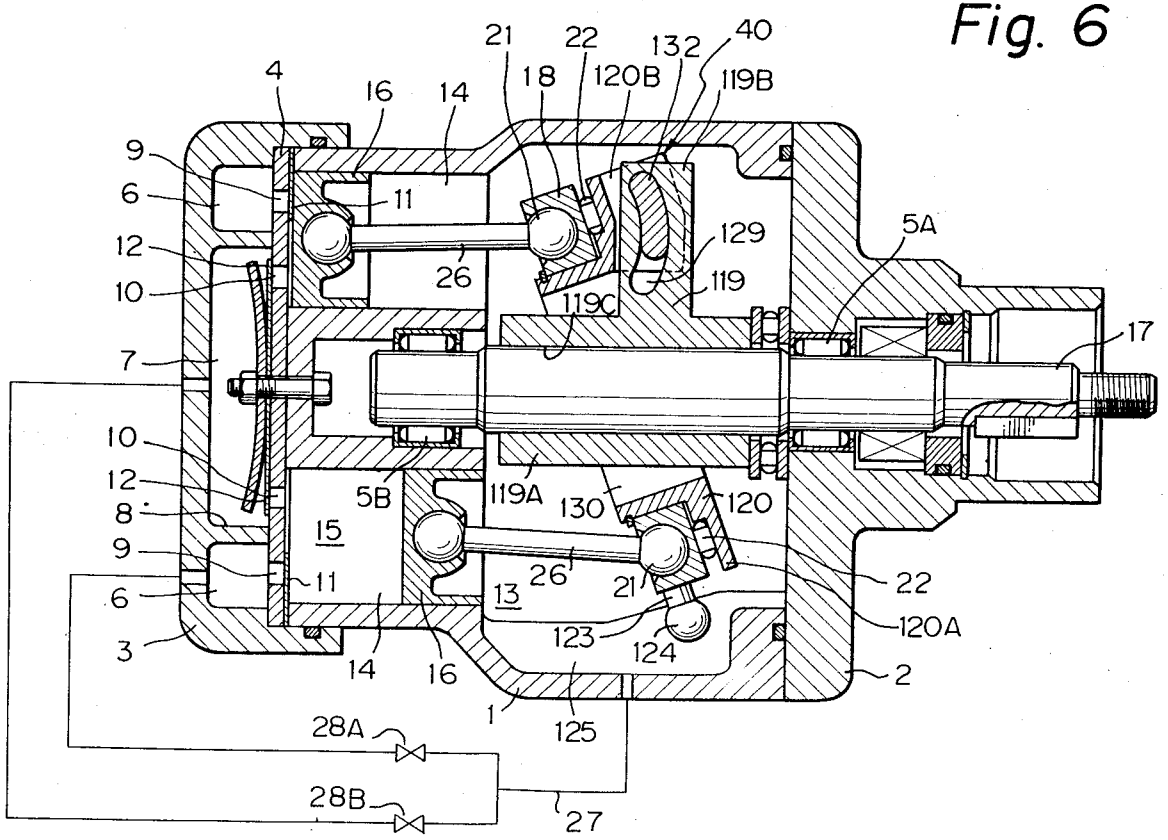
FIG. 6 is a cross-sectional view of a variable displacement swash plate type compressor, according to a second embodiment of the present invention.
Figure 7:
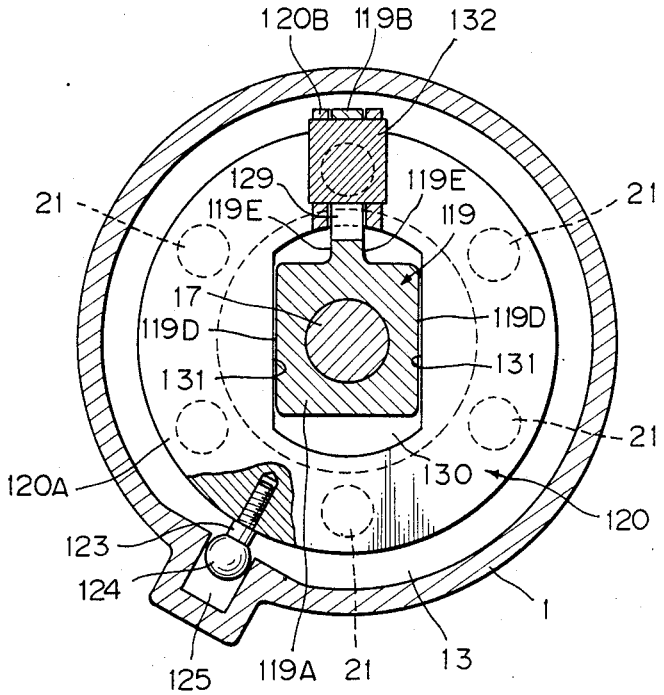
FIG. 7 is another cross-sectional view of the compressor of FIG. 6, illustrating the connection between a swash plate assembly and a drive shaft assembly.

FIGS. 6 and 7 illustrate a variable displacement, swash plate compressor of the second embodiment of the present invention. The same or like elements as those in the first embodiment of FIGS. 1 through 3 are designated by the same reference numerals. Further, since the present invention per se is related to the control mechanism for changing the compressor displacement, and since the compression mechanism of the compressor of FIGS. 6 and 7 is the same as that of the compressor of the first embodiment of FIGS. 1 through 3, only the description of the wobble angle changing mechanism of a swash plate assembly accommodated in the variable displacement compressor of FIGS. 6 and 7 will be provided hereunder. Therefore, it should be understood that those elements designated by respective reference numerals but not appearing in the description have substantially the same configuration and mechanical functions, respectively.

In the compressor of FIGS. 6 and 7, a swash plate assembly 40 is arranged in a crankcase 13 of a cylinder block 1 and mounted on a drive shaft 17. The swash plate assembly 40 includes a support member 119 fixedly secured to and rotatable with the drive shaft 17, a rotary swash plate 120 supported on the support member 119 so as to be rotatable with the support member 119 about the drive shaft 17 and capable of wobbling about an axis perpendicular to the axis of the drive shaft 17, and a non-rotary wobble plate 18 held by the rotary swash plate 120 so as to be capable of wobbling with the rotary swash plate 120. The support member 119 has a mount 119A by means of which the support member 119 is secured to the drive shaft 17 and a stand 119B on which the swash plate 120 is rotatably mounted as described later. As illustrated in FIG. 7, the mount 119A of the support member 119 is formed in a square bar portion having two opposite flat sides 119D and a central bore 119C in which the drive shaft 17 is snugly fitted so as to be integral with one another. The stand 119B of the support member 119 extends at a right angle to the drive shaft 17 and has two opposite flat sides 119E. The stand 119B also has an extended and curved hole 129. The center of the curvature of the hole 129 is located at a point that corresponds to the center of each ball bearing 21 disposed as a universal coupling between each connecting rod 26 and the wobble plate 18 everytime the support member 119 is brought to a position where the member is in alignment with each cylinder bore 14 of the cylinder block 1.

The swash plate 120 has an annular mounting flange 120A formed at an end of a cylindrical body 120C on which the wobble plate 18 is held with a bearing 22 intervened between an end face of the wobble plate 18 and an inner face of the annular mounting flange 120A. The cylindrical body 120C has, at the center thereof, a non-circular bore 130 through which the mount 119A of the support member 119 extends. The non-circular bore 130 of the cylindrical body 120C is formed with two flat inner faces 131 opposing the two flat sides 119D of the support member 119 and is so dimensioned that the swash plate 120 supported on the support member 119 may turn back and forth with respect to that member 119 and the drive shaft 17 under the guidance of the flat sides 119D of the support member 119.

The swash plate 120 also has a bracket 120B arranged at a part of the outer face of the mounting flange 120A. The bracket 120B is formed as bifurcated extensions from the mounting flange 120, which is capable of sandwiching therebetween the stand 119B of the support member 119. A support pin 132 is mounted so as to laterally pierce the bifurcated bracket 120B while passing through the curved hole 129 of the stand 119B. The support pin 132 has a curved configuration such that it may smoothly slide in the curved hole 129, thereby permitting the turning of the swash plate 120 with respect to the support member 119. That is, the support pin 132 has the same curvature as the extended and circularly curved hole 129.

The non-rotary wobble plate 18 held on the swash plate 120 is formed as an annular member enclosing the mount 119A of the support member 119 and the drive shaft 17. The non-rotary wobble plate 18 is provided, at a part of the outer circumference thereof, with a radial projection 123 which may be a small rod tightly screwed into the outer circumference of the wobble plate 18. The radial projection 123 has a ball bearing 124 rotatably mounted at an outer end of the projection 123. The ball bearing 124 is provided to prevent the wobble plate 18 from being rotated, and is disposed in an axially extended guide slot 125 so that the ball bearing 124 per se may rotate in the slot 25 when the wobble plate 18 wobbles.

The wobble plate 18 of the swash plate assembly 40 is operatively connected to each of the pistons 16 by means of a connecting rod 26 and two ball bearings 21 attached to both ends of the connecting rod 26. That is, the ball bearings 21 are provided so as to form a universal coupling between each connecting rod 26 and the associated piston 16 and the wobble plate 18, respectively. It should be understood that the above-mentioned operative connection between the pistons 16 and the wobble plate 18 is accomplished so that everytime the stand 119B of the support member 119 comes into alignment with one of the cylinder bores 14 during the running of the drive shaft 17, the associated piston 16 comes to the top dead center of its stroke within the cylinder bore 14 due to the wobbling motion of the wobble plate 18.

A conduit 27 and two valves 28A and 28B are arranged in the same manner as in the first embodiment of FIGS. 1 through 3. That is, when the valve 28A is opened, suction pressure (low pressure) is introduced from the suction chamber 6 into the crankcase 13 by way of the conduit 27, and when the valve 28A is closed and the other valve 28B is alternately opened, a discharge pressure (high pressure) is fed into the crankcase 13 by way of the same conduit 27. The introduction of the suction and discharge pressures into the crankcase 13 is effective for establishing between the compression chambers 15 of the cylinder bores 14 and the crankcase 13 a pressure difference which causes a change in the wobble angle of the wobble plate 18 and the swash plate 120 of the swash plate assembly 40 in the same manner as that of the swash plate assembly 30 of the first embodiment. The switching of the two valves 28A and 28B from one to the other is made in accordance with a cooling load condition in an air-conditioned area. However, one preferred way for alternately opening the two valves 28A and 28B is to switch from one to the other in such a manner that a predetermined gas pressure always prevails in the crankcase 13. For example, the switching of the valves 28A and 28B is conducted so that a gas pressure of 2.3 through 2.8 times atmospheric pressure is always maintained in the crankcase.

In accordance with the wobble angle changing mechanism of the swash plate assembly 40 of the second embodiment, the lateral support pin 132 is provided with a wide contact surface area slidably engaged with the curved inner wall of the circularly curved hole 129. Accordingly, the swash plate assembly 40 has sufficient physical strength to withstand a large reaction force from the compressing pistons 16. Also, the large contact surface area of the support pin 132 can provide a stable and reliable connection between the support member 119 and the wobble and swash plates 18 and 120. Accordingly, reliable operation in changing the wobble angle of the swash plate assembly 40 can be guaranteed.

Figure 8:
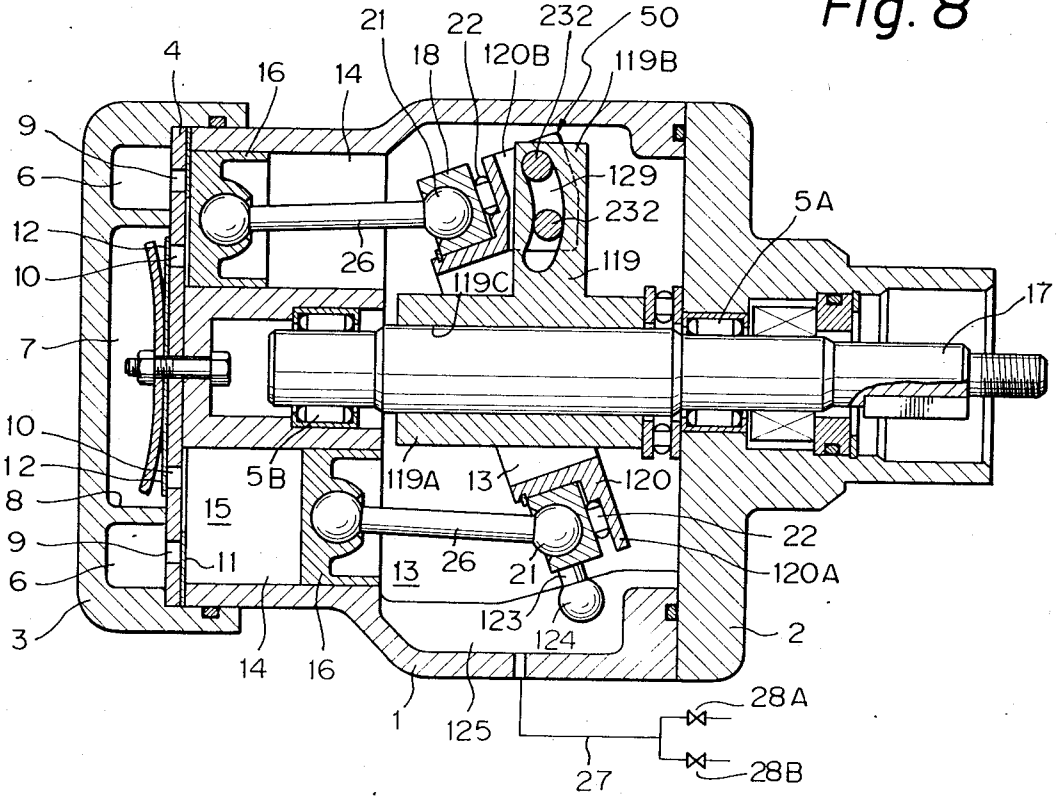
FIG. 8 is a cross-sectional view of a variable displacement swash plate type compressor, according to a third embodiment of the present invention.
Figure 9:
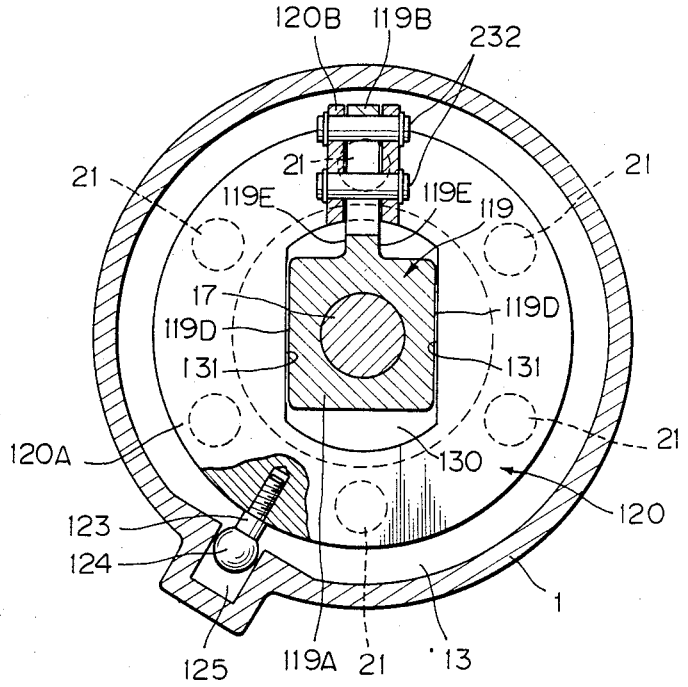
FIG. 9 is another cross-sectional view of the compressor of FIG. 8, illustrating the connection between a swash plate assembly and a drive shaft assembly.

FIGS. 8 and 9 illustrate the third embodiment of the present invention. This third embodiment can be regarded as a modification of the second embodiment because, in this third embodiment, not only the compression mechanism of the compressor but also the construction and arrangement of a swash plate assembly 50 are similar to those of the second embodiment, except that two spaced apart support pins 232 are employed in the third embodiment in place of the single support pin 132 of the second embodiment. Each of the support pins 232 consists of a round rod. The arrangement of the spaced apart two support pins 232 capable of sliding in the circularly curved hole 129 is effective for accomplishing a stable turning motion of the swash plate 120 and the wobble plate 18 of the swash plate assembly 50 when the wobble angle of both plates 120 and 18 is to be changed. It should be understood that since the two support pins 232 contact two separate points of the inner face of the circularly curved hole 129, the slidable connection of the swash plate 120 to the support member 119 can be rigid.

Figure 10:
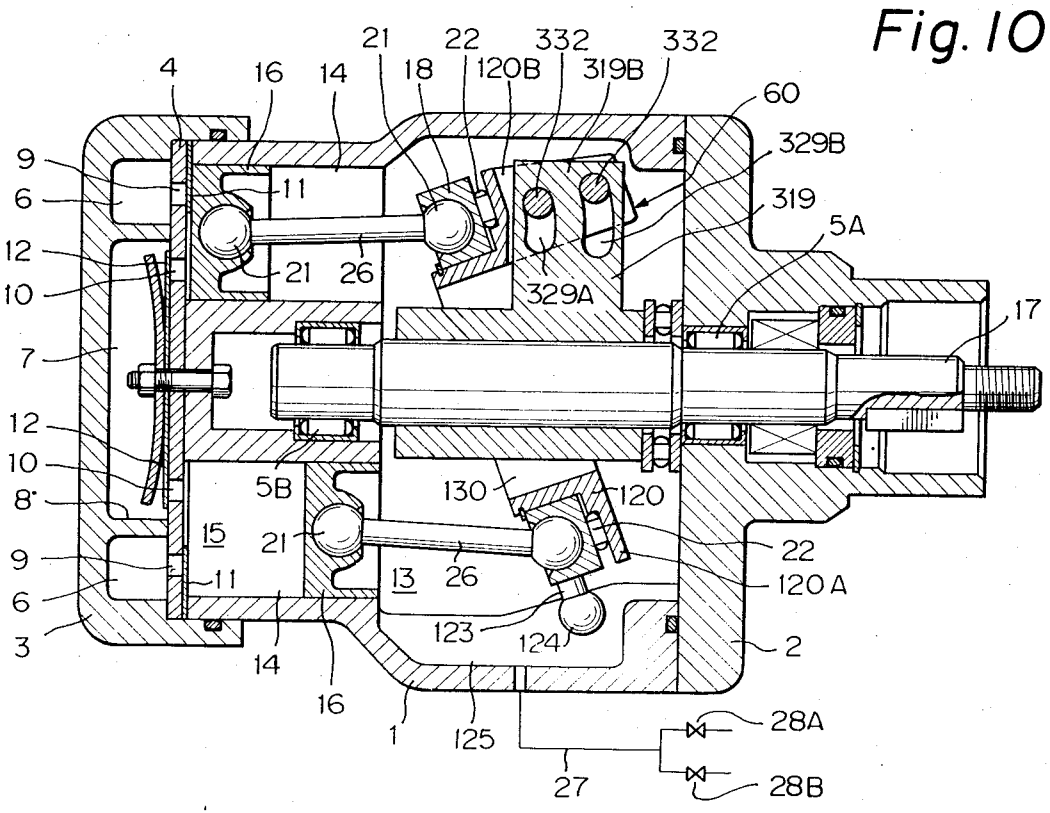
FIG. 10 is a cross-sectional view of a variable displacement swash plate type compressor, according to a fourth embodiment of the present invention.
Figure 11:
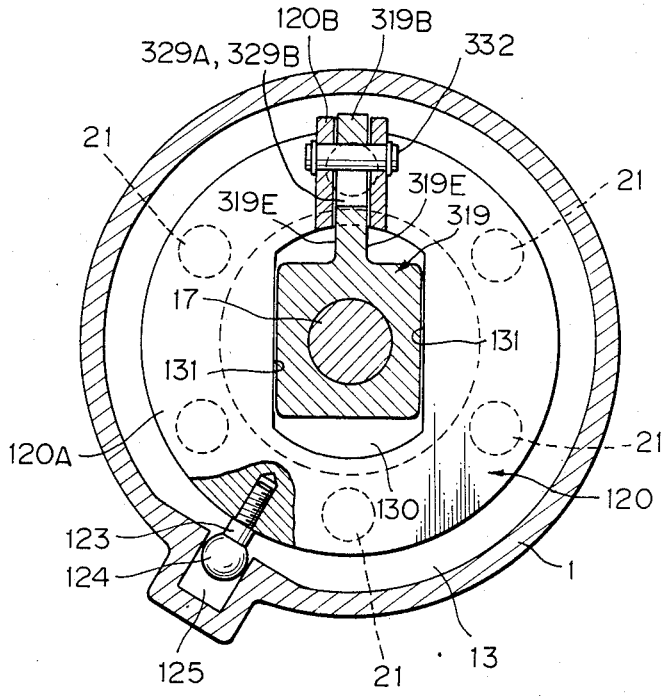
FIG. 11 is another cross-sectional view of the compressor of FIG. 10, illustrating the connection between a swash plate assembly and a drive shaft assembly.

FIGS. 10 and 11 illustrate the fourth embodiment of the present invention. This fourth embodiment can be regarded as another modification of the second embodiment of FIGS. 6 and 7. In the fourth embodiment, a swash plate assembly 60 is different from the assembly 40 of the second embodiment in that two separate support pins 332 are arranged so as to be engaged in two different roundly curved holes 319B and 329B which have a common center of curvature but different radii of curvature. It should be understood, however, that the operation of the swash plate assembly 60 is almost similar to the assembly 50 of the third embodiment of FIGS. 8 and 9. That is, the fourth embodiment can also enjoy the same advantages as the third embodiment described above.

Figure 12:
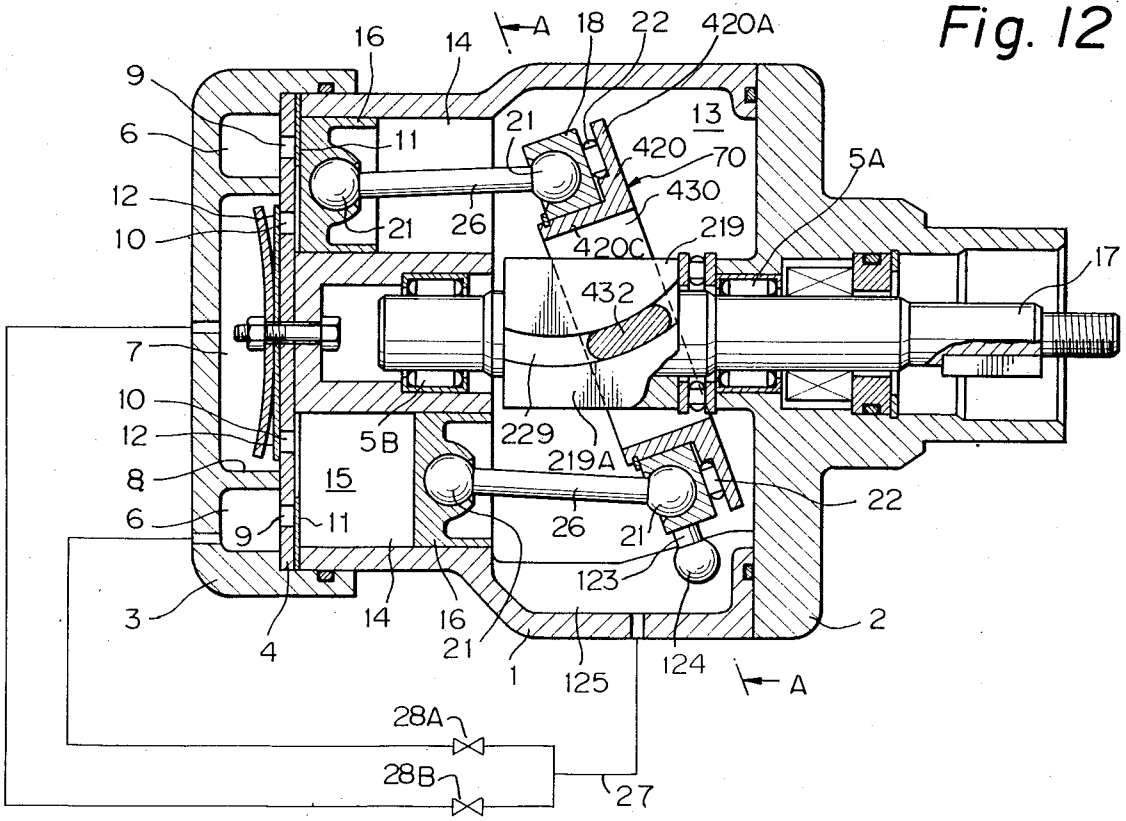
FIG. 12 is a cross-sectional view of a variable displacement swash plate type compressor, according to a fifth embodiment of the present invention.
Figure 13:
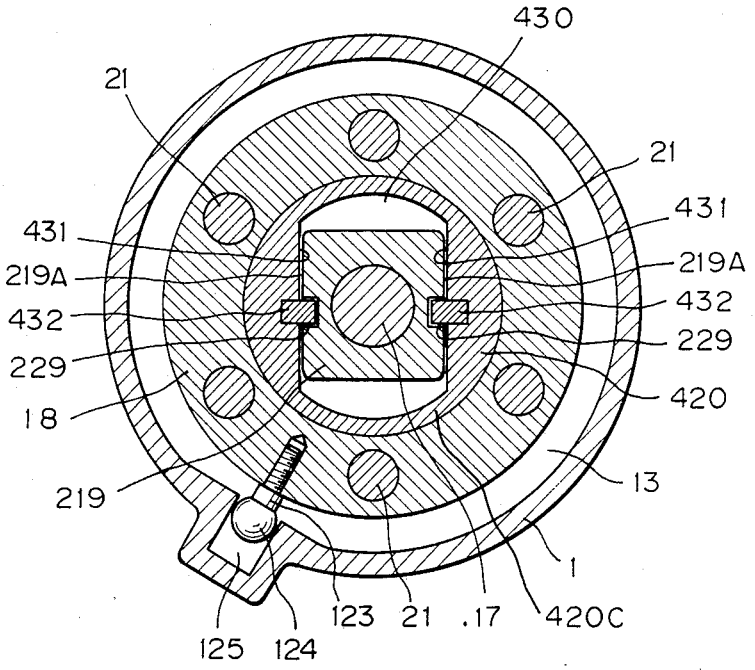
FIG. 13 is another cross-sectional view of the compressor of FIG. 12, taken along the line A—A of FIG. 12.

FIGS. 12 and 13 illustrate a variable displacement swash plate type compressor according to the fifth embodiment of the present invention. The same or like elements as those in the preceding embodiments are designated by the same reference numerals. Further, since the compressor of this fifth embodiment is different from that of the embodiment described above only in the construction and arrangement of a wobble swash plate assembly accommodated in the compressor, only the description of that swash plate assembly will be provided hereunder.

In the compressor of FIGS. 12 and 13, a wobble swash plate assembly 70 is arranged in a crankcase 13 and mounted on a drive shaft 17 so as to reciprocate respective pistons 16 in cylinder bores 14 in compliance with rotation of the drive shaft 17. The swash plate assembly 70 includes a support member 219 fixedly mounted on or integral with the drive shaft 17, a rotary swash plate 420 supported on the support member 219, and a non-rotary wobble plate 18 held on the swash plate 420. The support member 219 is formed in a non-round bar element or portion having two parallel flat sides 219A, as shown in FIG. 13. The two flat sides 219A are formed with a roundly curved guide groove 229, respectively. Each of the guide grooves 229 has a radius of curvature which enables the wobble angle of the swash plate 420 to be changed about an axis crossing the axis of the drive shaft 17 at a right angle, preferably an axis perpendicular to the axis of the drive shaft 17. The center of the curvature of each guide groove 229 is a point lying in a plane parallel to a plane that includes a center of connection of one of connecting rods 26 and the wobble plate 18, and the axis of the drive shaft 17 when the piston 16 associated with that one of the connecting rods 26 is the top dead center of its stroke.

The swash plate 420 has an annular mounting flange 420A formed at an end of a cylindrical body 420C on which the wobble plate 18 is held with a bearing 22 intervened between an end face of the wobble plate 18 and an inner face of the mounting flange 420A. The cylindrical body 420C has, at the center thereof, a non-circular bore 430 through which the support member 219 and the drive shaft 17 extend. The non-circular bore 430 is formed with two flat inner walls 431 opposing the afore-mentioned two flat sides 219A of the support member 219 and is dimensioned so that the swash plate 420 supported on the support member 219 may turn back and forth with respect to the support member 219 as well as the drive shaft 17 under the guidance of the flat sides 219A of the support member 219. A pair of support pins 432 are fixed to the flat sides 219A of the support member 219 so as to project toward one another and into the respective guide grooves 229 of the above-mentioned support plate. It will be understood from FIG. 12 that the support pins 432 are provided with a configuration and dimension capable of complementarily and slidably engaging in the guide grooves 229, respectively, and therefore have roundly curved upper and lower large slide surfaces, respectively. That is, stable support of the swash plate 420 on the support member 219 can be ensured by the engagement of the support pins 432 in the guide grooves 229.

The non-rotary wobble plate 18 held on the swash plate 420 is formed as an annular member enclosing the support member 219 and the drive shaft 17. The non-rotary wobble plate 18 is provided, at a part of the outer circumference thereof, with a radial projection 123 having a rotatably mounted ball bearing 124 at an outer end thereof. The ball bearing 124 is provided to prevent the wobble plate from being rotated, and is disposed in an axially extended guide slot 125 so that the ball bearing 124 may rotate in the slot 125 when the wobble plate 18 wobbles. The non-rotary wobble plate 18 is operatively connected to each of the pistons 16 by means of a connecting rod 26 and two ball bearings 21 attached to both ends of the connecting rod 26. That is, the ball bearings 21 are provided so as to form a universal coupling between each connecting rod 26 and the associated piston 16 and the wobble plate 18, respectively. It should be understood that the above-mentioned operative connection between the pistons 16 and the wobble plate 18 is accomplished so that everytime a portion of the swash plate 420, located at a position extending from one of the flat sides 219A of the support plate 219 comes into alignment with one of the cylinder bores 14 during the running of the drive shaft 17, the associated piston 16 comes to the top dead center of its stroke within the cylinder bore 14, due to the wobbilng motion of the wobble plate 18.

A conduit 27 and two valves 28A and 28B are arranged in the same manner as in the preceding embodiments of the present invention so that a pressure difference for causing a change in a wobble angle of the swash plate assembly 70 is established in the crankcase 13 in association with a change in a cooling load in an air-conditioned area, e.g., a vehicle compartment. When the wobble angle of the swash plate assembly 70 is changed, the assembly 70 is turned about an axis passing the centers of the curvature of the two guide grooves 229 due to the sliding of the support pins 432 in the guide grooves 229.

In accordance with the wobble angle changing mechanism of the swash plate assembly 70 of the fifth embodiment, the support pins 432 are provided with a wide sliding surface area, respectively. Accordingly, mechanical durability of the wobble angle changing mechanism can be very high. Further, physical strength of the swash plate assembly 70 is sufficient to withstand a large reaction force from the compressing pistons 16. Therefore, reliable operation in changing the wobble angle of the swash plate assembly 70 can be guaranteed. Thus, reliable operation in varying a compressor displacement of the swash plate type compressor in association with a cooling load condition within an air-conditioned area can be obtained.

Figure 14:
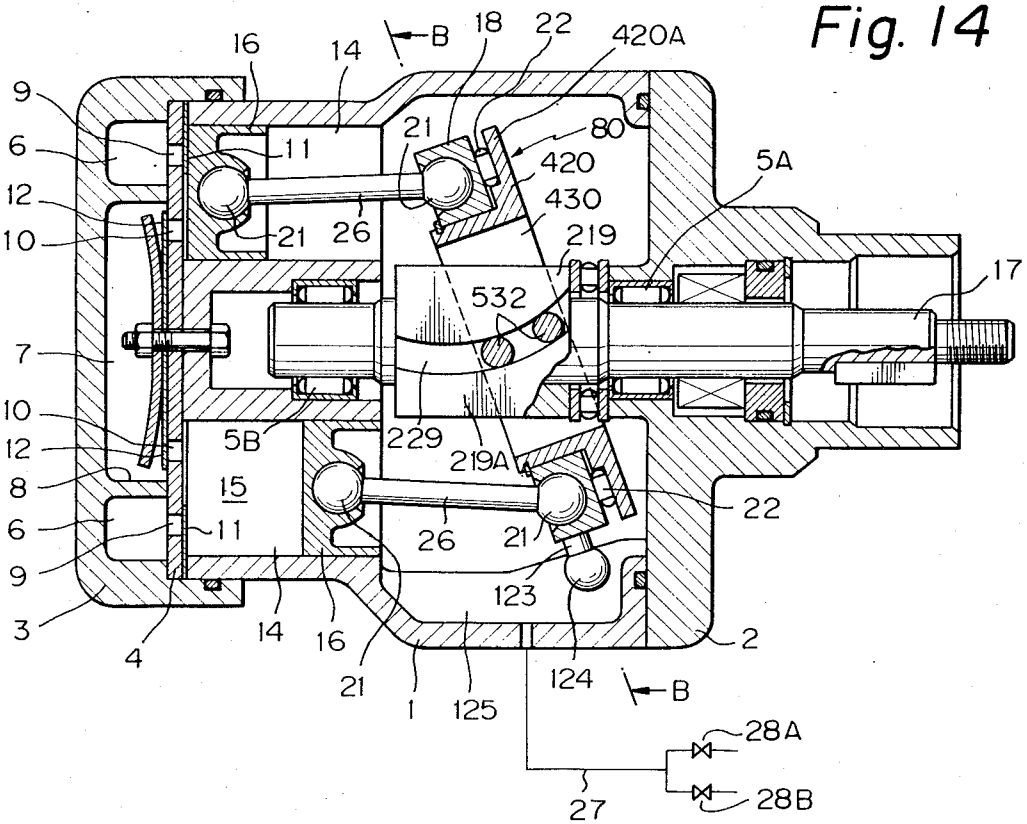
FIG. 14 is a cross-sectional view of a variable displacement swash plate type compressor, according to a sixth embodiment of the present invention.
Figure 15:
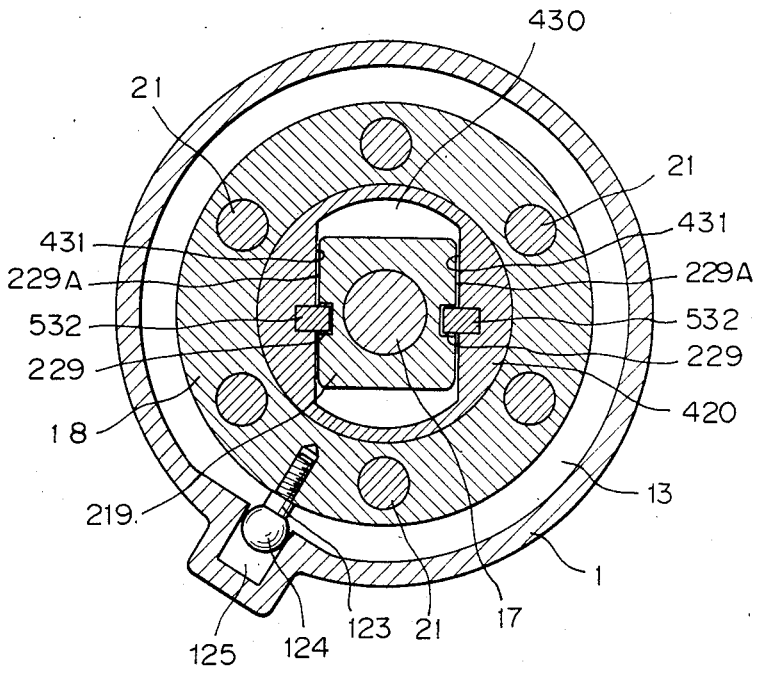
FIG. 15 is a cross-sectional view of the compressor of FIG. 14, taken along the line B—B of FIG. 14.

FIGS. 14 and 15 illustrate the sixth embodiment of the present invention. However, this sixth embodiment can be regarded as a modification of the fifth embodiment. This is because, in the sixth embodiment, not only the compression mechanism of the compressor but also the construction and arrangement of a swash plate assembly 80 are similar to those of the fifth embodiment, except that a pair of two spaced apart support pins 532 are fixed to each of the flat inner walls 431 of the swash plate 420 of the compressor of the sixth embodiment in place of fixing the single support pin 432 to each flat inner wall 431 of the swash plate 420 of the compressor of the fifth embodiment. Each of the support pins 532 consists of a round pin. The arrangement of the spaced apart two support pins 532 capable of sliding in each curved guide groove 229 is effective for accomplishing a stable turning motion of the swash plate 420 and the wobble plate 18 of the swash plate assembly 80 when the wobbling angle of both plates 420 and 18 is to be changed. It should be understood that since the support pins 532 are in contact with separate points of each guide groove 229, the sliding connection of the swash plate 420 to the support member 219 can be rigid.

Figure 16:
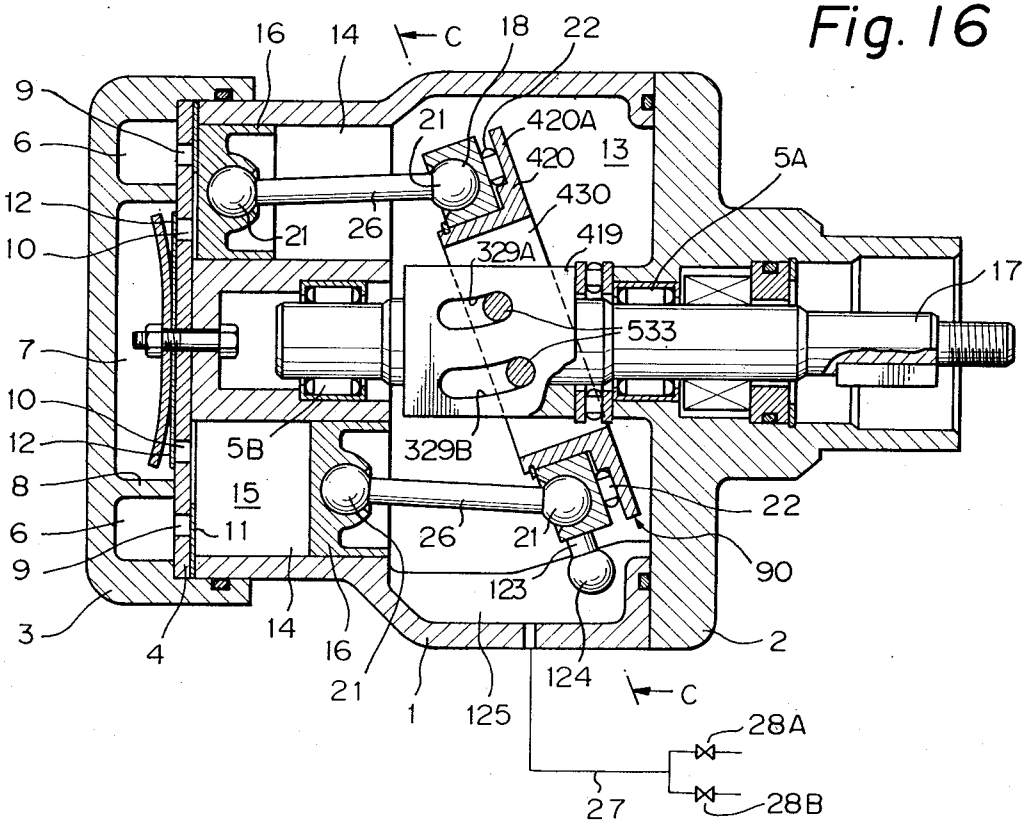
FIG. 16 is a cross-sectional view of a variable displacement swash plate type compressor, according to a seventh embodiment of the present invention.
Figure 17:
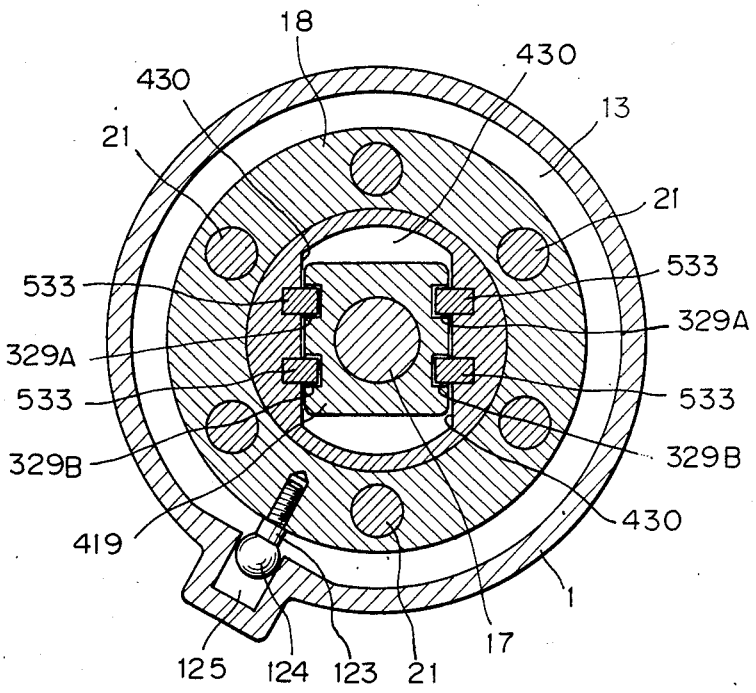
FIG. 17 is a cross-sectional view, taken along the line C—C of FIG. 16.

FIGS. 16 and 17 illustrate the seventh embodiment of the present invention. This seventh embodiment also can be regarded as a modification of the fifth embodiment of FIGS. 12 and 13. In the seventh embodiment, a swash plate assembly 90 is different from the assembly 70 of the fifth embodiment of FIGS. 12 and 13 in that two separate support pins 533 on each side of the swash plate 420 are arranged so as to be engaged in two different guide grooves 329A and 329B which have a common center of curvature but different radii of curvature. It should be understood, however, that the operation of the swash plate assembly 90 is substantially similar to the assembly 80 of the sixth embodiment of FIGS. 14 and 15. Thus, the seventh embodiment of FIGS. 16 and 17 can enjoy the same advantages as in the sixth embodiment described above.

The foregoing description of the preferred embodiments is made only for the purpose of illustrating the present invention. Many further modifications and variations may occur to a person skilled in the art without departing from the scope of the claims.

We claim:

1. A variable displacement swash plate type compressor including a cylinder block having therein a plurality of cylinder bores arranged circumferentially around a central axis thereof along which a drive shaft is arranged so as to axially extend and also having therein a crankcase communicated with the plurality of cylinder bores, a first housing attached to one end of the cylinder block so as to form suction and discharge chambers which are alternately communicated with each of the plurality of cylinder bores, second housing attached to the other end of the cylinder block so as to close the crankcase of the cylinder block, a plurality of pistons slidably fitted in the cylinder bores and reciprocating so as to compress a refrigerant gas drawn from the suction chamber and then discharge the compressed gas into the discharge chamber, and a swash plate assembly arranged in the crankcase and mounted on the drive shaft so as to reciprocate the pistons, the swash plate assembly including a swash plate capable of rotating with the drive shaft while wobbling about an axis perpendicular to a rotating axis of the drive shaft, and a non-rotatable wobble plate held on the swash plate, operatively connected to the pistons by connecting rods, and capable of wobbling with the swash plate, said swash plate and wobble plate being arranged so that the wobble angle thereof can be changed in response to a change in a pressure condition of the crankcase established by a conduit means communicating the crankcase with one of the suction and discharge chambers, wherein said swash plate assembly comprises means for supporting said swash plate so as to be free to turn about an axis extending at a right angle to the rotating axis of said drive shaft and passing through points which come into registration with respective centers of connection of said connecting rods and said wobble plate when said pistons are at the top dead center of their strokes thereof with said cylinder bores, wherein said means for supporting said swash plate comprise a supporting member fixedly mounted on said drive shaft and defining therein at least a roundly curved and recessed portion having an inner face and a center of curvature thereof located on said axis about which said swash plate is free to turn, and an engaging means having an outer face and fixedly mounted on said swash plate and having said outer face complemental with and turnably in face contact with at least two positions of said inner face of said roundly curved and recessed portion of said support member.

2. A variable displacement swash plate type commpressor, including a cylinder block having therein a plurality of cylinder bores arranged circumferentially around a central axis thereof along which a drive shaft is arranged so as to axially extend and also having therein a crankcase communicated with the plurality of cylinder bores, a first housing attached to one end of the cylinder block so as to form suction and discharge chambers which are alternately communicated with each of the plurality of cylinder bores, a second housing attached to the other end of the cylinder block so as to close the crankcase of the cylinder block, a plurality of pistons slidably fitted in the cylinder bores and reciprocating so as to compress a refrigerant gas drawn from the suction chamber and then discharge the compressed gas into the discharge chamber, and a swash plate assembly arranged in the crankcase and mounted on the drive shaft so as to reciprocate the pistons, the swash plate assembly including a swash plate capable of rotating with the drive shaft while wobbling about an axis perpendiuclar to a rotating axis of the drive shaft, and a non-rotatable wobble plate held on the swash plate, operatively connected to the pistons by connecting rods, and capable of wobbling with the swash plate, said swash plate and wobble plate being arranged so that the wobble angle thereof can be changed in response to a change in a pressure condition of the crankcase established by a conduit means communicating the crankcase with one of the suction and discharge chambers, wherein said swash plate assembly comprises means for supporting said swash plate so as to be free to turn about an axis extending at a right angle to the rotating axis of said drive shaft and passing through points which come into registration with respective centers of connection of said connecting rods and said wobble plate when said pistons are at the top dead center of their strokes thereof within said cylinder bores, wherein said means for supporting said swash plate comprise a supporting member fixedly mounted on said drive shaft and defining therein at least a roundly curved and recessed portion having a center of curvature thereof located on said axis about which said swash plate is free to turn, and an engaging means fixedly mounted on said swash plate and having at least an engaging portion turnably in contact with at least two positions of said roundly curved and recessed portion of said support member, wherein said supporting member comprises a semicircular arc member provided therein with a semicircurlarly recessed inner face formed as said roundly curved and recessed portion, and wherein said engaging means comprise a semicircular-shaped head provided with a semicircular curved outer face complementarily and slidably engaged in said semicircular recessed inner face of said supporting member, said semicircular-shaped head being fixed to an outer peripheral portionof said swash plate.

3. A variable displacement compressor according to claim 2, wherein said semicircular recessed inner face has a semicircular extended tooth formed so as to be engaged with a semicircular extended groove formed in said semicircular curved outer face of said semicircular head, whereby a rotary drive force is transmitted from said drive shaft to said swash plate.

4. A variable displacement compressor according to claim 2, wherein said semicircular recessed inner face of said semicircular arc member has as semicircular extended groove formed so as to be engaged with a semicircular extended tooth provided in said semicircular curved outer face of said semicircular head, whereby a rotary drive force is transmitted from said drive shaft to said swash plate.

5. A variable displacement compressor according to claim 2, wherein said semicircular recessed inner face of said semicircular arc member has a semicircular extended and convex surface formed so as to be engaged with a semicircular extended and concave surface provided in said semicircular curved outer face of said semicircular head, whereby a drive force is transmitted from said drive shaft to said swash plate.

* * * * *